US011305921B1

(12) United States Patent
Price

(10) Patent No.: US 11,305,921 B1
(45) Date of Patent: Apr. 19, 2022

(54) LEVER LID CONTAINER WITH CHILD-RESISTANT LID RELEASE

(71) Applicant: Planet Canit, LLC, Highland Park, IL (US)

(72) Inventor: Virginia Price, Highland Park, IL (US)

(73) Assignee: Planet Canit, LLC, Highland Park, IL (US)

( * ) Notice: Subject to any disclaimer, the term of this patent is extended or adjusted under 35 U.S.C. 154(b) by 0 days.

(21) Appl. No.: 16/999,786

(22) Filed: Aug. 21, 2020

Related U.S. Application Data

(60) Provisional application No. 62/890,681, filed on Aug. 23, 2019.

(51) Int. Cl.
*B65D 43/26* (2006.01)
*B65D 43/02* (2006.01)

(52) U.S. Cl.
CPC ..... *B65D 43/267* (2013.01); *B65D 43/021* (2013.01); *B65D 2543/00092* (2013.01); *B65D 2543/00296* (2013.01); *B65D 2543/00509* (2013.01); *B65D 2543/00898* (2013.01)

(58) Field of Classification Search
CPC ..... B65D 2313/04; B65D 43/267; B65D 43/021; B65D 2543/00092; B65D 2543/00296; B65D 2543/00509; B65D 2543/00898; B65D 2543/00435; Y10S 211/01
See application file for complete search history.

(56) References Cited

U.S. PATENT DOCUMENTS

| | | | | |
|---|---|---|---|---|
| 1,545,859 A | | 7/1925 | Snook | |
| 1,609,351 A | | 12/1926 | Eustege | |
| 1,725,726 A | | 8/1929 | Ament | |
| 1,769,415 A | * | 7/1930 | Byberg | B65D 43/0222 220/284 |

(Continued)

FOREIGN PATENT DOCUMENTS

| | | |
|---|---|---|
| ES | 2245164 B1 | 3/2003 |
| GB | 191303289 A | 7/1913 |

(Continued)

OTHER PUBLICATIONS

United States Consumer Product Safety Commission, "Child Resistant Packaging: ASTM Index Type," https://www.cpsc.gov/Regulations-Laws-Standards/Statutes/Poison-Prevention-Packaging-Act/CRP-ASTM-Type, last updated Jun. 29, 2017; 7 pages.

*Primary Examiner* — Shawn M Braden
(74) *Attorney, Agent, or Firm* — Foley & Lardner LLP

(57) ABSTRACT

A container employs an access tool in child-resistant packaging. The container includes a container body having a sidewall and a base. A bottom surface defines a recess at a lower end of the container body. The container includes a lid that covers an aperture at an upper end of the container body when the container is closed, and a lever ring. The lever ring defines the aperture and is configured to receive and grip a plug portion of the lid. When not in use, the access tool is magnetically attached to the bottom surface, hidden from view. In use, the access tool is a lever configured to abut against the lever ring as fulcrum to pry the lid away from the lever ring. In an embodiment, the container has a circular cylindrical body, the lever ring has an annular shape, and the access tool is a circular disc.

16 Claims, 6 Drawing Sheets

(56) References Cited

U.S. PATENT DOCUMENTS

| | | | | |
|---|---|---|---|---|
| 2,078,743 | A | 4/1937 | Traum | |
| 2,379,680 | A | 7/1945 | Ralph | |
| 2,633,041 | A * | 3/1953 | Aue | B67B 7/14 81/3.55 |
| 2,940,633 | A | 6/1960 | Thacker | |
| 3,785,311 | A | 1/1974 | Yoshikawa | |
| 4,087,018 | A | 5/1978 | Tebbutt | |
| 4,147,271 | A | 4/1979 | Yamaguchi | |
| 4,225,045 | A | 9/1980 | Rayner et al. | |
| 4,577,776 | A | 3/1986 | Rayner et al. | |
| 4,606,474 | A | 8/1986 | Dudzik | |
| 4,799,602 | A | 1/1989 | Collins et al. | |
| 4,887,735 | A | 12/1989 | Dudzik | |
| 5,261,558 | A | 11/1993 | Claydon | |
| 6,837,089 | B2 | 1/2005 | Jentzsch | |
| 8,939,306 | B2 | 1/2015 | Rios | |
| 9,463,910 | B2 | 10/2016 | Schandl | |
| 9,527,338 | B1 | 12/2016 | Kalb | |
| 9,878,833 | B2 | 1/2018 | Phillips | |
| 10,307,006 | B2 | 6/2019 | Knoll | |
| 2008/0283527 | A1 | 11/2008 | Allen | |
| 2010/0116824 | A1 * | 5/2010 | Stalions | B65D 77/067 220/495.06 |
| 2011/0000912 | A1 * | 1/2011 | Roeterdink | B65D 51/20 220/258.2 |

FOREIGN PATENT DOCUMENTS

| | | | |
|---|---|---|---|
| GB | 296942 | A | 9/1928 |
| GB | 2 237 607 | A | 5/1991 |
| GB | 2460226 | A | 11/2009 |
| NL | 9301232 | A | 2/1995 |

* cited by examiner

LEVER LID CONTAINER WITH CHILD-RESISTANT LID RELEASE

CROSS-REFERENCE TO RELATED APPLICATION

The present application claims benefit of U.S. Provisional App. No. 62/890,681, filed Aug. 23, 2019, which is incorporated by reference in its entirety.

TECHNICAL FIELD

The present disclosure relates generally to child-resistant packaging for the packaging and dispensing of articles, and more particularly to child-resistant closures for containers with lids.

BACKGROUND

In the field of child-resistant packaging, there are many forms of safety closure designed to prevent or render it difficult for children to remove the closure from packaging. Such safety closures are employed for example in containers that store medicines or other contents that might be harmful without supervision. Various types of child-resistant or safety containers have been developed that include a receptacle for storing contents, and a lid that is locked in the closed position using some type of locking mechanism. Various child-resistant containers or safety containers require some not readily apparent manipulation of the closure before it can be removed from the associated container. However, such containers can be relatively complex in construction and operation, and can require difficult manipulations of the closure for releasing the locking mechanism. Many of these safety containers, although child-resistant, have proven inconvenient and cumbersome to operate for the users.

Some types of child-resistant packaging, such as the child-resistant containers of the present disclosure, require an implement for removing a closure. This category of child-resistant packaging requires a key device, coin, or other tool to open the packaging and access contents. In the present disclosure, this category of child-resistant packaging is sometimes called tooled access, and the required tool is sometimes called an access tool. One limitation of conventional child-resistant packaging using tooled access is that an access tool, although child-resistant, can be inconvenient and cumbersome to operate for the users. Other characteristics of child-resistant packaging using tooled access are the need to house or store the access tool when not in use, and the need to locate the access tool when needed to open a closure. While these characteristics of tooled access can represent significant safety factors for child-resistant packaging, they can pose substantial difficulties for other users.

SUMMARY

What is needed is an improved child-resistant container incorporating a tool designed for or otherwise suitable for opening a closure mechanism of the container. What is needed is child-resistant containers with safety factors based on the need to locate an access tool and the need to know how to use the tool to open the container and access its contents. What is needed is child-resistant containers with tool access that offers convenience for authorized users. What is needed is improved child-resistant containers that include a receptacle for storing contents, a lid that is locked via a closure mechanism, and an access tool configured to open the closure.

In an embodiment of a child-resistant container employing tooled access, a container includes a container body having a sidewall, and a base including a lower edge of the cylindrical sidewall and a bottom surface. The bottom surface defines a recess at a lower end of the container body and the lower edge of the sidewall extends beyond the bottom surface. The container includes a lid configured to cover an aperture at an upper end of the container body when the container is closed, and a lever ring at the upper end of container body attached adjacent to an upper edge of the sidewall. The lever ring defines the aperture and is configured, when the container is closed, to receive and grip a plug portion of the lid to cover the aperture. In an embodiment, the container sidewall is cylindrical. In an embodiment, the container has a circular cylindrical container body, the aperture is circular, and the lever ring has an annular shape.

The child-resistant tool further includes an access tool configured, when not in use, to be removably attached to the bottom surface. In an embodiment, the access tool is a lever tool configured, when in use, to abut against a portion of the lever ring as fulcrum and to pry the lid away from the lever ring. The lever tool is dimensioned to fit within the bottom recess when the container rests against the lower edge of the cylindrical sidewall, so that the lever tool is hidden from view when not in use.

In an embodiment, the lever tool includes an opener tool attached to or integral with a magnet. The lever tool is configured to be removably attached to the bottom surface via magnetic attraction. In an embodiment, the container is a container tin, and the bottom surface is a tinplate closure at the lower end of the container body.

In an embodiment, a child-resistant container comprises a container body having a sidewall; a base including a lower edge of the sidewall and a bottom surface, wherein the bottom surface defines a recess at a lower end of the container body, and wherein the lower edge of the sidewall extends beyond the bottom surface; a lid configured to cover an aperture at an upper end of the container body when the container is closed; a lever ring at the upper end of container body attached adjacent an upper edge of the sidewall and defining the aperture, the lever ring configured, when the container is closed, to receive and grip a plug portion of the lid to cover the aperture; and a lever tool configured, when in use, to abut against a portion of the lever ring as fulcrum and to pry the lid away from the lever ring and further configured, when not in use, to be removably attached to the bottom surface, wherein the lever tool is dimensioned to fit within the recess defined by the lower edge of the sidewall and the bottom surface.

In an embodiment, A child-resistant container comprises a container body having a sidewall; a base including a lower edge of the sidewall and a bottom surface, wherein the bottom surface defines a recess at a lower end of the container body, and wherein the lower edge of the sidewall extends beyond the bottom surface; a lid, configured to cover an aperture at an upper end of the container body when the container is closed; a lever ring at the upper end of container body attached adjacent an upper edge of the sidewall and defining the aperture, the lever ring configured, when the container is closed, to receive and grip a plug portion of the lid to cover the central aperture; and a lever tool comprising an opener tool attached to or integral with a magnet, the lever tool configured, when in use, to abut against a portion of the lever ring as fulcrum and to pry the lid away from the lever ring and further configured, when not in use, for the magnet to be magnetically adhered to the bottom surface.

BRIEF DESCRIPTION OF THE DRAWINGS

The present disclosure can be better understood by referring to the following figures. The components in the figures are not necessarily to scale, emphasis instead being placed upon illustrating the principles of the disclosure. In the figures, reference numerals designate corresponding parts throughout the different views.

DETAILED DESCRIPTION

Figure 1:
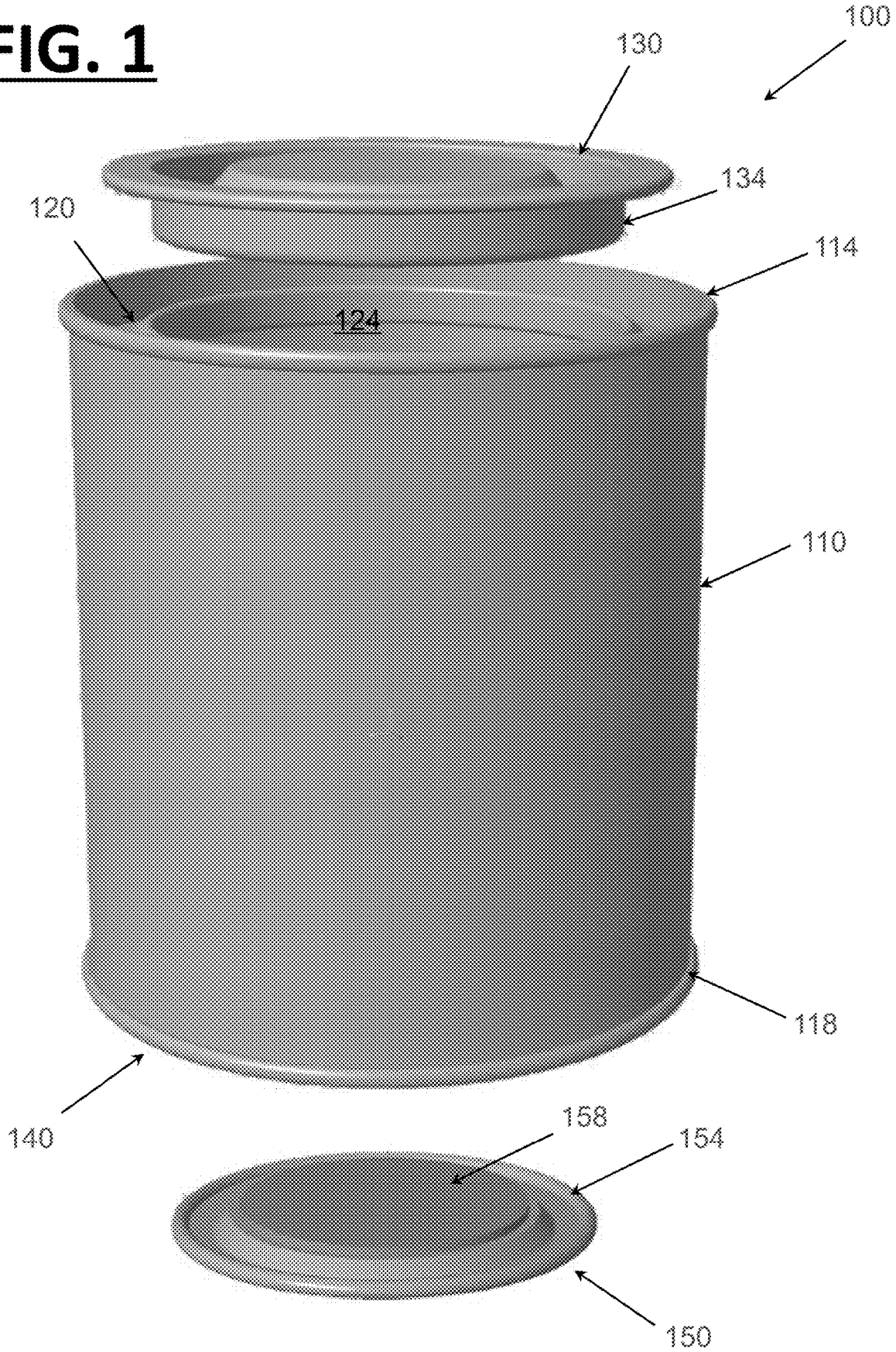
FIG. 1 is a perspective view of a round container tin with lever lid and child-resistant opener device removed from the container, according to an embodiment.

The present disclosure is here described in detail with reference to embodiments illustrated in the drawings, which form a part here. Other embodiments may be used and/or other changes may be made without departing from the spirit or scope of the present disclosure. The illustrative embodiments described in the detailed description are not meant to be limiting of the subject matter presented here.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to one skilled in the relevant art and having possession of this disclosure, are to be considered within the scope of the invention.

In many applications, reclosable containers are designed with child safety as a paramount consideration. One type of reclosable container is the lever lid tin, which has been widely employed in packaging of paint, coatings, powders and adhesives, as well as other products such as food products. The lever lid container tin of the present disclosure incorporates a child-resistant opener device.

A lever lid container tin requires the use of an access tool to open it. Commonly, the access tool is used to pry open the lever lid. The child-resistant container tin of the present invention makes use of the facts that children may be unable to locate a suitable access tool, and may encounter difficulties in using the tool. Specifically, in order to successfully lift the lid, the tool must initially have one end accurately positioned under the circumferential edge of the lid. Then, the tool must be pushed inwards (i.e., towards the center of the lid) to prevent the end slipping out, while the free end of the tool must be pulled down in order to lift the lid. Such action may require a high level of both dexterity and strength, beyond the capability of many children.

FIG. 1 is a perspective view of a round container tin with a lever lid and a child-resistant opener device removed from the container. Container 100 is a round cylindrical container made of tinplate. Container tin 100 includes a body 110 in the form of a cylindrical sidewall. Container 100 includes a lever ring 120 that is attached to the top of the sidewall by an upper seam 114. FIG. 1 shows a lever lid 130 removed from circular opening 124 of lever ring 120. Container body 110 includes a bottom surface at lower end of the container body (not visible in this view). In an embodiment, the bottom surface is a closure attached to the container body by a lower seam 118.

Another component of child-resistant container tin 100 is access tool 150, also herein called lever tool or simply lever. Access tool 150 includes an opener device 154 in the form of a flanged circular disc, and a magnet 158 secured above the center of the opener device 154. Although access tool 150 is shown separately below lever lid tin 100 in FIG. 1, normally when it is not being used to open the lever lid tin, access tool 150 would be hidden below the base of tin 100.

Figure 2:
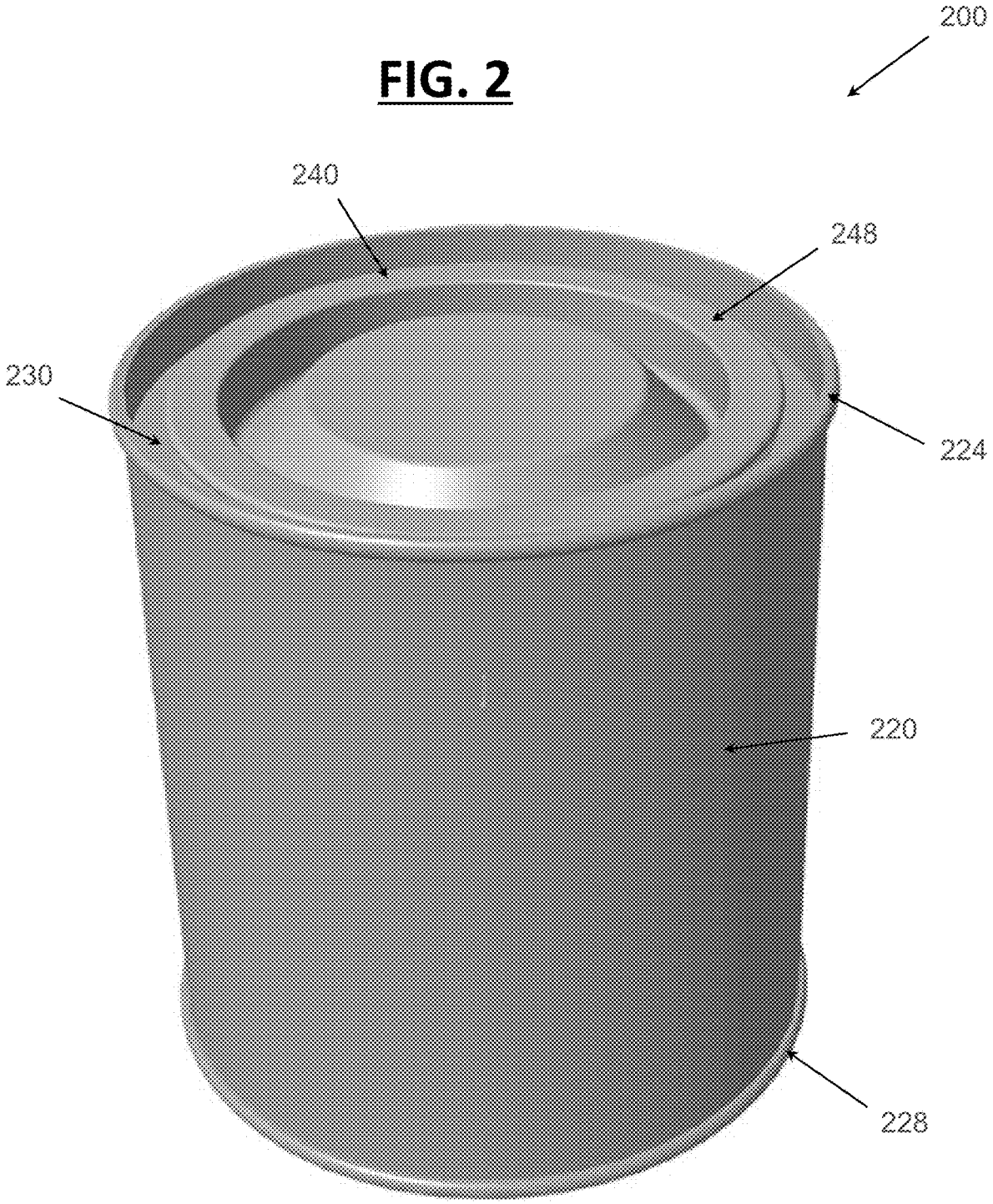
FIG. 2 is a perspective view of a round container tin with lever lid closed, according to an embodiment.

FIG. 2 shows an embodiment of a child-resistant container tin 200 including a container body 220, lever ring 230, and lever lid 240. The cylindrical sidewall of container body 220 is closed at one end by the lever ring 230 and lever lid 240. In an embodiment, each of the components 220, 230, and 240 of container tin 200 is formed of tinplate. In other embodiments, the container tin may have a composite construction, in which one or more of the cylindrical sidewall, the lever ring, and the lid are formed of a polymeric material, but a lower surface of the container is formed of tinplate. In various embodiments, the cylindrical sidewall has a side seam that may be a folded and soldered side seam or a lap welded side seam. The container tin includes an upper seal 224 that interlocks the sidewall of container body 220 with the lever ring 230, and a lower seal 228 that interlocks the sidewall of container body 220 with a bottom closure (not shown) of container 200. The lever ring 230 defines a shoulder area at the top of container 200 to receive the lever lid 240. Lever lid 240 is tightly secured within lever ring 230 such that it is difficult if not impossible to open using just the user's hands.

Figure 3:
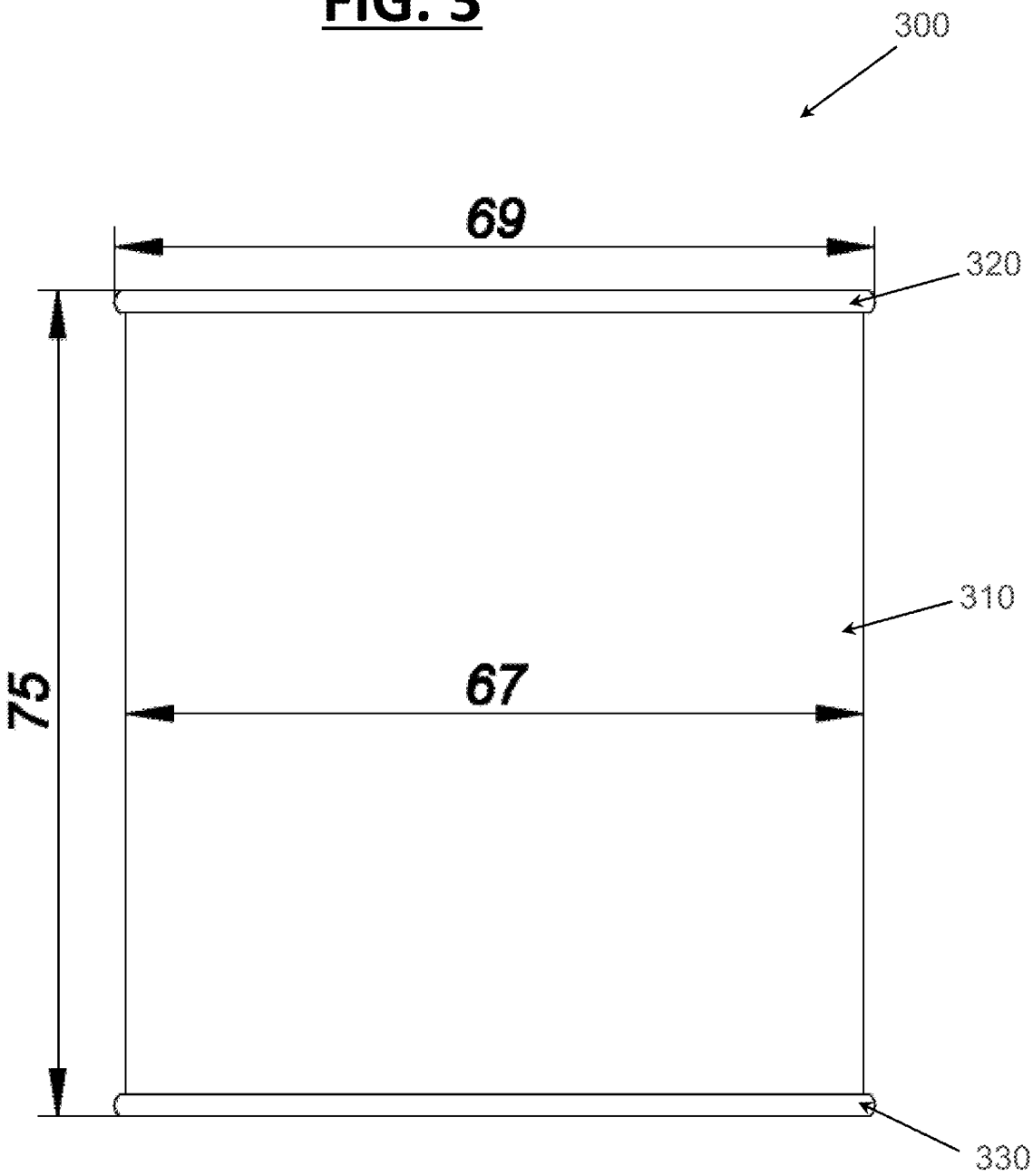
FIG. 3 is a side elevation of a round container tin, according to an embodiment.

In the side elevation view of FIG. 3, container tin 300 has a container body 310, upper seal 320 and lower seal 330. In an embodiment, seals 320 and 330 are double seals. Container body 310 is a circular cylinder with an outer diameter of 67 mm and a height of 75 mm. Seals 320 and 330 have an outer diameter of 69 mm.

Figure 4:
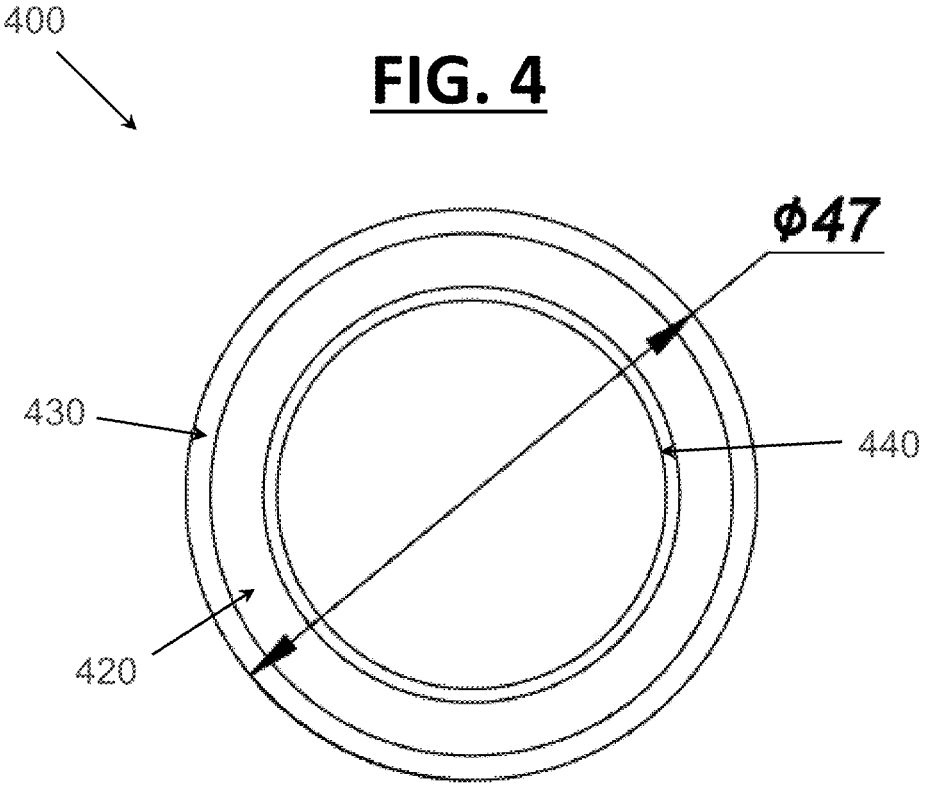
FIG. 4 is a plan view of an access tool for a child-resistant lever lid container, according to an embodiment.

FIG. 4 is a plan view of an access tool 400 for a child-resistant lever lid container. Access tool 400 includes an opener device 420 in the form of a disc. Opener disc 420 has a flanged periphery or rim 430 and acts as a lever to remove the lid from the top of the container tin, e.g., by prying the lid from a lever ring. Additionally, opener device 420 includes a magnet 440 on one side of the opener tool, which is used to magnetically adhere the opener device 420 to the bottom of the container tin. In an exemplary embodiment, opener device 420 is a circular disc with an outer diameter of 47 mm, and magnet 440 is a concentric circular cylinder of lower diameter than disc 420.

Figure 5:
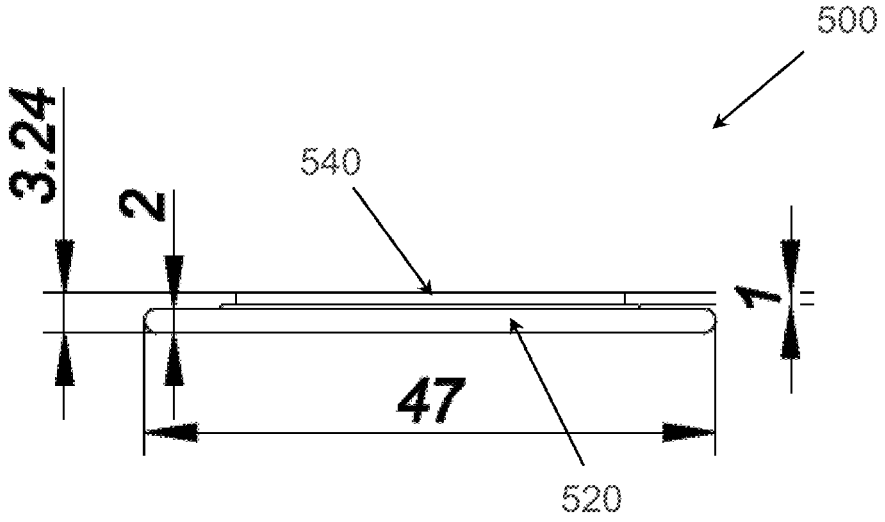
FIG. 5 is an elevation view of an access tool for a child-resistant lever lid container, according to an embodiment.

FIG. 5 is an elevation view of an access tool 500 for a child-resistant lever lid container. The access tool includes an opener device 520 in the form of a disc, and a magnet 540 secured to an upper surface of the opener disc 520. In an embodiment, magnet 540 is permanently laminated or bonded to disc 520. In an exemplary embodiment, access tool 500 has a total thickness of 3.24 mm, including a 2 mm thickness of opener tool 520 and a 1 mm thickness of magnet 540. Disc 520 has an outer diameter of 47 mm.

Figure 6:
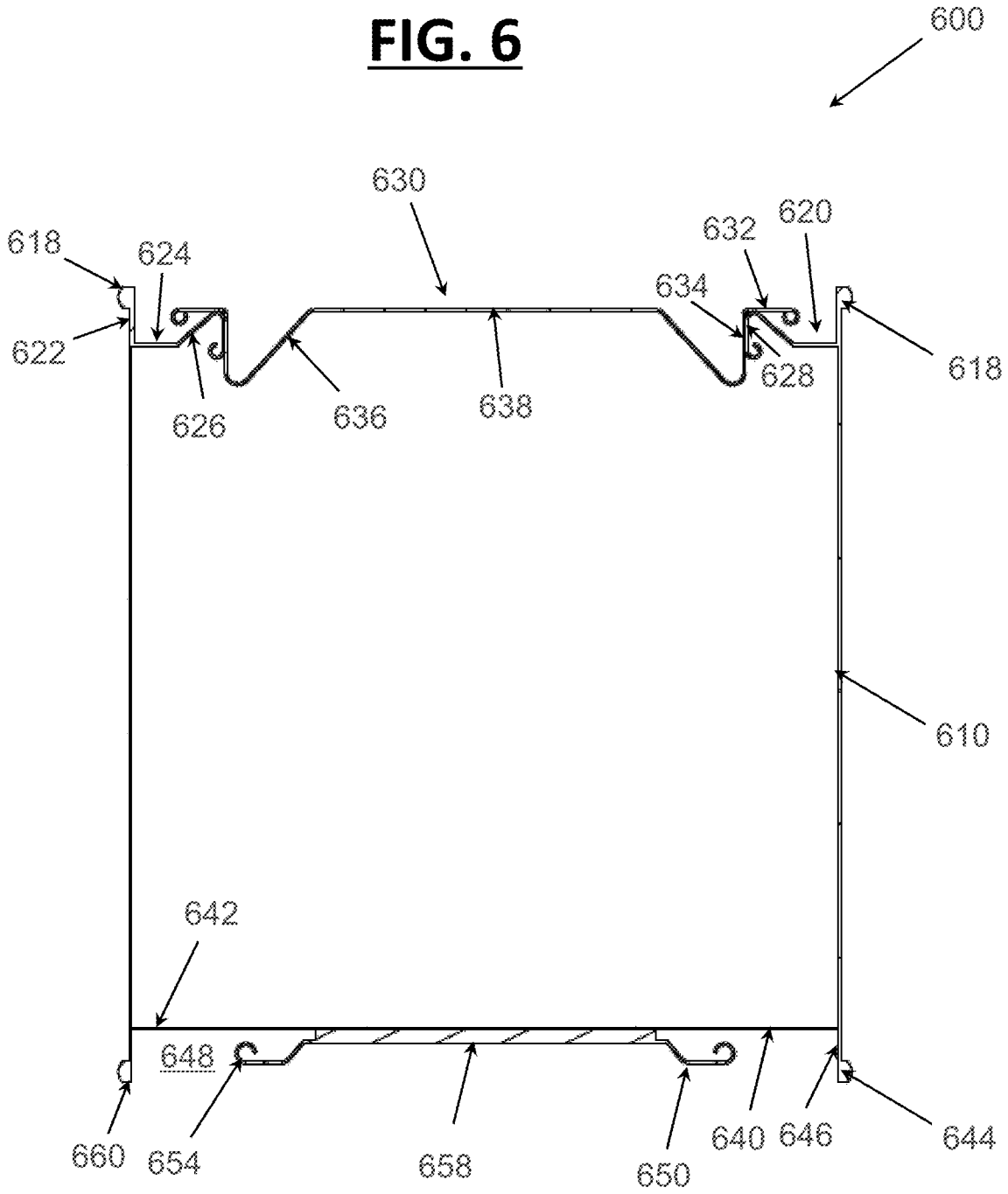
FIG. 6 is a side elevation of a round container tin with closed lever lid and child-resistant opener device sectioned on a diameter of the container, according to an embodiment.

FIG. 6 is a side elevation of a round container tin 600 with a lever lid 630 closed within lever ring 620. A child-resistant opener device 650 is magnetically adhered at the bottom of the container tin. An annular cover hook 618 provides double seaming to container body 610. Lever ring 620 includes a chuck wall 622 that depends from the inner periphery of the cover hook 618 and extends to a folded portion 624. The folded portion 624 supports a flared portion 626 that extends axially and radially in a generally upward direction. A cylindrical lid receiving portion 628 depends from flared portion 626. Lever lid 630 includes a flange 632 and a plug wall 634 that seals against the lid receiving portion 628. A frustoconical wall 636 extends axially and upwardly to support a central panel 638 of lid 630.

An annular cover hook 644 interlocks the cylindrical sidewall of container body 610 with a bottom closure 640 and provides double seaming to container body 610. Bottom closure 640 includes a horizontal bottom surface 642 and a chuck wall 646 that extends upwardly to the bottom surface 642 from the inner periphery of the cover hook 644. An opener device 650 is magnetically adhered to bottom surface 642 via magnet 658. In an embodiment, at least the bottom surface 642 of container tin 650 is formed of a ferromagnetic metal, or a paramagnetic metal that is magnetized in the presence of magnet 658 to attract and retain the opener device 650. In an embodiment, at least the bottom surface 642 of container tin 600 is formed of tinplate steel, i.e., steel with a very thin coating of tin. In an embodiment, at least the bottom surface 642 of container tin 600 is formed of chromium/chromium oxide coated steel (known as TFS in the trade).

The lower edge 660 of the container body sidewall extends beyond the bottom surface 642, defining a recess 648 below the bottom surface. The outer diameter of opener device 650 (e.g., 47 mm) is well under the inner diameter of recess 648 (e.g., 67 mm) so that opener device 650 fits easily within the recess 648. The vertical clearance provided by recess 648 (e.g., 5 mm) is greater than the total thickness (e.g., 3.24 mm) of opener device 650 including magnet 658 and opener tool 654. As a result, opener device 650 will not interfere with the container tin 600 sitting level on the lower edge 660 of container body 610, and opener device 650 will not be visible below the container.

The plug wall 634 of lever lid 630 is dimensioned to provide a tight interference fit within the lid receiving portion 628 of lever ring 620. The tinplate lever ring 620 is relatively rigid during forcing of the lever lid 630 into the lid receiving portion 628 of lever ring 620, providing a child-resistant closure in which removal by hand is very difficult if not impossible. To open the child-resistant container tin, a user who is aware of the hidden opener device 650 can detach the device from the bottom of the tin. In an embodiment, the user inserts opener disc 654 between the lever lid 630 and lever ring 620 to open the lid 630. In an embodiment, the user rests the opener disc 654 against the cover hook 618 as fulcrum and presses the rim of opener disc 654 up against the flange 632 as lever to pry the lid 630 open. If the lid 630 is particularly tightly engaged within lever ring 620, the user may progressively apply force at several points under the flange of the lid to permit removal of the lid.

In the embodiments of FIGS. 1-6, the container and the access tool are both circular. However, a lever lid with access tool can be implemented with any shape/size container (e.g., rectangle, square, round, oval, polygon). The lever lid itself can be generally round but the lever ring that it fits into can follow the shape of the container with just a round aperture in the middle for the actual lever lid. As used herein, "lever ring" may describe an annular or ring-shaped portion of the container, but also may have other shapes consistent with the shape of the container. In the container 200 of FIG. 2, the container body 220 has a circular cylindrical sidewall closed at one end by annular lever ring 230 with a round aperture in the middle for lever lid 240. In the container 700 of FIG. 7, the container body 720 has a substantially rectangular sidewall closed at one end by lever ring 730 that follows the rectangular shape of the container with a round aperture in the middle for lever lid 740.

Figure 7:
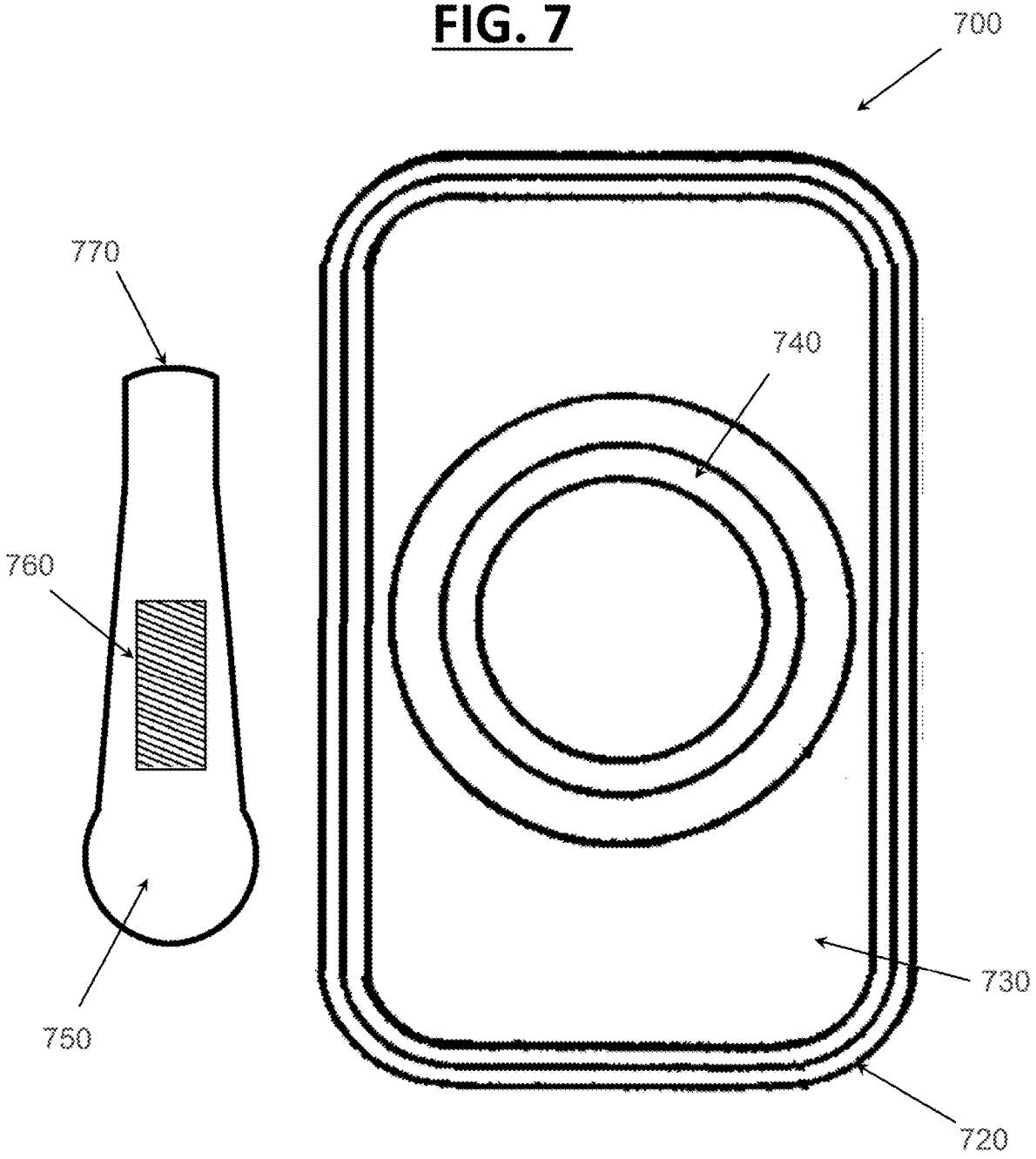
FIG. 7 is a perspective view of a non-round container tin with lever lid closed, and an access tool removed from the container, according to an embodiment.

In lieu of an access tool in the form of a circular disk 150 as shown in FIG. 1, the container 700 may incorporate an access tool 750 having a non-circular shape. The access tool includes a compact opener device dimensioned to fit below the base of the container hidden from view. In the example of FIG. 7, the access tool is dimensioned to fit below a substantially rectangular surface bottom surface at the base of container 700 (not visible in this view). In use, non-circular lever tool 750 is a hand-held device that acts as a lever to remove the lid from the top of the container tin. In various embodiments, the non-circular lever tool 750 includes a peripheral surface such as a straight or curved tip and is configured to rest against a portion of the lever ring 730 as fulcrum. The user presses down a free end of the tool 750 to force the tip of the tool up against the lever lid 740 and pry open the lid.

The foregoing method descriptions and the interface configuration are provided merely as illustrative examples and are not intended to require or imply that the steps of the various embodiments must be performed in the order presented. As will be appreciated by one of skill in the art, the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations can be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

What is claimed is:

1. A child-resistant container, comprising:

a container body having a sidewall;

a base including a lower edge of the sidewall and a bottom surface, wherein the bottom surface defines a recess at a lower end of the container body, and wherein the lower edge of the sidewall extends beyond the bottom surface;

a lid configured to cover an aperture at an upper end of the container body when the container is closed;

a lever ring at the upper end of container body attached adjacent an upper edge of the sidewall and defining the aperture, the lever ring configured, when the container is closed, to receive and grip a plug portion of the lid to cover the aperture; and a lever tool configured, when in use, to abut against a portion of the lever ring as fulcrum and to pry the lid away from the lever ring and further configured, when not in use, to be removably attached to the bottom surface, wherein the lever tool is dimensioned to fit within the recess defined by the lower edge of the sidewall and the bottom surface, wherein the container has a circular cylindrical container body and a circular bottom surface, and wherein the lever tool comprises a circular disc.

2. The container of claim 1, wherein the lever tool comprises an opener tool attached to or integral with a magnet and is configured to be removably attached to the bottom surface via magnetic attraction.

3. The container of claim 2, wherein the container is a container tin, and the bottom surface is a tinplate closure at the lower end of the container body.

4. The container of claim 2, wherein the container is a container tin, the bottom surface is a tinplate closure at the lower end of the container body, and one or more of the sidewall, the lever ring, and the lid are formed of a polymeric material.

5. The container at claim 1, wherein the lever tool comprises a circular disc attached to or integral with a magnet, wherein the magnet comprises a concentric circular cylinder of lower diameter than the circular disc.

6. The container tool of claim 1, wherein the lever tool has a flanged periphery or rim.

7. The container of 1, wherein the aperture is circular, and the lever ring has an annular shape.

8. The container of claim 1, wherein the plug portion of the lid has an interference fit within the aperture defined by lever ring when the container is closed.

9. A child-resistant container, comprising:

a container body having a sidewall;

a base including a lower edge of the sidewall and a bottom surface, wherein the bottom surface defines a recess at a lower end of the container body, and wherein the lower edge of the sidewall extends beyond the bottom surface;

a lid configured to cover an aperture at an upper end of the container body when the container is closed;

a lever ring at the upper end of container body attached adjacent an upper edge of the sidewall and defining the aperture, the lever ring configured, when the container is closed, to receive and grip a plug portion of the lid to cover the aperture; and a lever tool configured, when in use, to abut against a portion of the lever ring as fulcrum and to pry the lid away from the lever ring and further configured, when not in use, to be removably attached to the bottom surface, wherein the lever tool is dimensioned to fit within the recess defined by the lower edge of the sidewall and the bottom surface, wherein the container has a non-circular cylindrical container body, the aperture is circular, and the lever ring follows the non-circular shape of the container and defines the circular aperture at a middle area of the lever ring.

10. A child-resistant container, comprising:

a container body having a sidewall;

a base including a lower edge of the sidewall and a bottom surface, wherein the bottom surface defines a recess at a lower end of the container body, and wherein the lower edge of the sidewall extends beyond the bottom surface;

a lid, configured to cover an aperture at an upper end of the container body when the container is closed;

a lever ring at the upper end of container body attached adjacent an upper edge of the sidewall and defining the aperture, the lever ring configured, when the container is closed, to receive and grip a plug portion of the lid to cover the central aperture; and a lever tool comprising an opener tool attached to or integral with a magnet, the lever tool configured, when in use, to abut against a portion of the lever ring as fulcrum and to pry the lid away from the lever ring and further configured, when not in use, for the magnet to be magnetically adhered to the bottom surface, wherein the container has a circular cylindrical container body and a circular bottom surface, and wherein the lever tool comprises a circular disc.

11. The container of claim 10, wherein the lever tool is dimensioned to fit within the recess when the container rests against the lower edge of the sidewall.

12. The container of claim 10, wherein the container is a container tin, and the bottom surface is a tinplate closure at the lower end of the container body.

13. The container of claim 10, wherein the container is a container tin, the bottom surface is a tinplate closure at the lower end of the container body, and one or more of the cylindrical sidewall, the lever ring, and the lid are formed of a polymeric material.

14. The container at claim 10, wherein the magnet comprises a concentric circular cylinder of lower diameter than the circular disc.

15. The container tool of claim 10, wherein the lever tool has a flanged periphery or rim.

16. The container of claim 10, wherein the aperture is circular, and the lever ring has an annular shape.

* * * * *